US005533837A

United States Patent [19]

Correia et al.

[11] Patent Number: 5,533,837

[45] Date of Patent: Jul. 9, 1996

[54] ANCHOR FOR RETAINING WALL FORMED OF SUPERIMPOSED CONCRETE BLOCKS

[76] Inventors: Horacio Correia, 1675 Rougemont, Canada; Charles Ciccarello, 8750 San Francisco, both of Brossard, Quebec, Canada

[21] Appl. No.: 199,787

[22] Filed: Feb. 22, 1994

[51] Int. Cl.[6] ..... E02D 29/02

[52] U.S. Cl. ..... 405/262; 405/284; 405/286

[58] Field of Search ..... 405/262, 289, 405/286; 52/597, 604, 698, 712, 714

[56] References Cited

U.S. PATENT DOCUMENTS

| | | | |
|---|---|---|---|
| 2,127,770 | 7/1992 | Ditcher et al. | 405/262 |
| 4,661,023 | 4/1987 | Hilfiker | 405/262 |
| 4,909,010 | 3/1990 | Gravier | 405/286 |
| 5,033,912 | 7/1991 | Vidal | 405/262 |
| 5,174,688 | 12/1992 | Meheen | 405/262 |
| 5,222,836 | 7/1993 | Nanayakkara | 405/262 |
| 5,282,700 | 2/1994 | Rodrique | 405/284 |

*Primary Examiner*—Ramon S. Britts
*Assistant Examiner*—Frederick L. Lagman

[57] ABSTRACT

An anchor adapted for providing retention strength to a retaining formed of a plurality of superimposed blocks having opposed faces adapted to lie one on top of another. One of the faces, of at least some of the blocks, has a longitudinal channel therein disposed spaced from a rear wall thereof and extending along a longitudinal axis of the block. A transverse groove is provided in the top face and extends from the longitudinal groove to the rear wall. The anchor has an elongated stem section, a hook end adapted for engagement in the longitudinal channel, and an opposed anchor end for engagement with back-fill material disposed behind the retaining wall.

5 Claims, 1 Drawing Sheet

ANCHOR FOR RETAINING WALL FORMED OF SUPERIMPOSED CONCRETE BLOCKS

TECHNICAL FIELD

The present invention relates to an anchor which is connectable to at least some of the blocks of a plurality of superimposed blocks which form a retaining wall whereby the wall is anchored into back-fill material deposited behind the wall.

BACKGROUND ART

It has been known to anchor retaining walls formed of wooden logs or concrete blocks by providing anchor means, usually in the form of logs which are secured to the retainer wall members and laid at right angles to the retaining walls and anchored in a fill-material deposited behind the wall. When using concrete blocks it is also known to connect a netting to various rows of concrete blocks as the retaining wall is built up and to embed this netting in back-fill material. However, most of these anchoring structures are expensive to construct and time consuming to install.

SUMMARY OF INVENTION

It is therefore a feature of the present invention to provide an anchor which is adapted to be connected to at least some of the blocks which are superimposed to form retaining walls to add retention strength to the retaining wall by anchoring some of the blocks to back-fill material deposited therebehind.

Another feature of the present invention is to provide an anchor for a retaining wall, which anchor is economical to fabricate, easy to install, and which provides added retention strength to a retaining wall formed of concrete superimposed blocks.

According to the above features, from a broad aspect, the present invention provides an anchor adapted for providing retention strength to a retaining wall formed of a plurality of superimposed blocks having opposed faces adapted to lie one on top of another. One of the faces, of at least some of the blocks, has a longitudinal channel therein disposed adjacent a rear end edge thereof and extending along a longitudinal axis of the block. A transverse groove is provided in the top face and extends from the longitudinal groove to the rear end wall of the block. The anchor has an elongated stem section, a hook end adapted for engagement in the longitudinal channel, and an opposed anchor end for engagement with back-fill material disposed behind the retaining wall.

SUMMARY OF INVENTION

BRIEF DESCRIPTION OF DRAWINGS

A preferred embodiment of the present invention will now be described with reference to the accompanying drawings in which.

Figure 1:
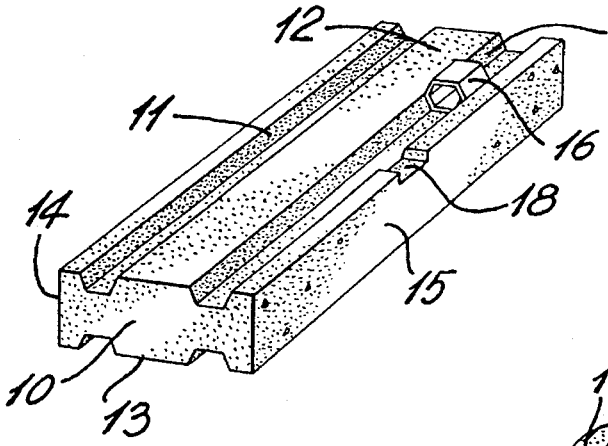
FIG. 1 is a perspective view of a retaining wall block provided with a channel and transverse groove adapted to receive an anchor of the present invention.

Referring now to the drawings, there is shown generally in FIG. 1 a retaining wall block 10 and adapted to be superimposed and interlocked with other blocks to form a retaining wall which extends either in a vertical plane or in a rearward inclined plane. The block 10 is provided with channels 11 disposed in the top face 12 and bottom face 13 in a manner described in my aforementioned patent application and spaced from the front wall 14 and the rear wall 15, respectively. Connecting elements 16 are disposed in some of these channels 11 and 11' to interconnect the blocks together when superimposed one on top of the other, as shown in FIG. 2, to form a retaining wall 17, partly shown in FIG. 2.

With additional reference now to FIGS. 2 to 4B, it can be seen that channel 11' which is disposed adjacent the rear wall 15 is provided with a transverse groove 18 or a few of these grooves 18, in the top face 12 thereof and extending transversely from the longitudinal groove 11' to the rear wall 15. Although in this particular embodiment the groove 11' extends longitudinally from end to end of the block 10, it is conceivable that, if only a single channel 11 is provided in the block top and bottom faces, a short longitudinal groove 11' may be provided adjacent the rear wall 15 with the transverse groove 18 to provide anchoring of the block by an anchor 20.

Figure 2:
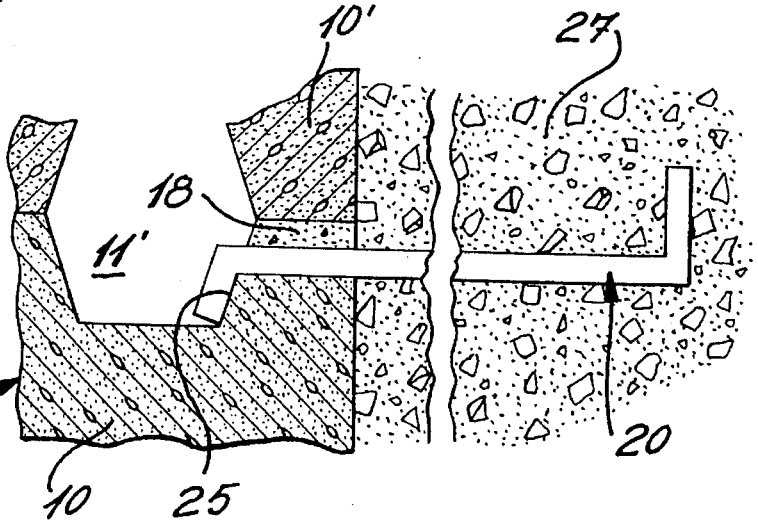
FIG. 2 is a fragmented section view showing the anchor of the present invention secured to a block superimposed in a retaining wall formed of a plurality of such blocks.

As illustrated in FIGS. 2 to 4B, the anchor 20 is stamped from metal or may be molded of structural plastics or like material and defines an elongated stem section 21, a hook end 22, and an anchor end 23. As herein shown, the hook end 22 is formed by a rectangular flange 22' formed integrally at a first end 24 of the stem 21 and is bent at an angle so as to abut flush against a rear side wall 25 of the longitudinal channel 11' and as shown in FIG. 2.

Figure 3B:
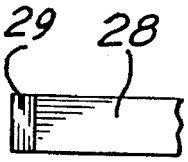
FIG. 3B illustrates a modification of the hook end of the anchor of FIG. 3A.
Figure 3A:
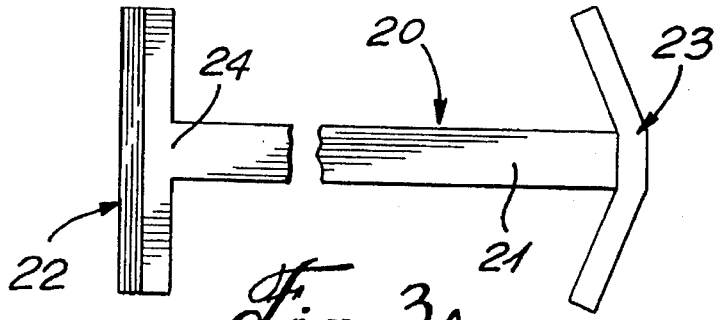
FIG. 3A is a fragmented top view showing one form of the anchor of the present invention.

As shown in FIG. 3A, the stem section is a flat stem of substantially rectangular cross-section and it is dimensioned to extend through the transverse groove 18 in an unobstructing manner so as to permit the blocks 10 to be superimposed one on top of the other without interference by the stem of the anchor. Although not shown in FIG. 2, the stem is substantially in close fit within the channel 18, and this is not shown in FIG. 2 in order to more clearly illustrate the anchor located in the channel.

Figure 4B:
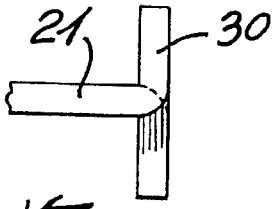
FIG. 4B is a top view showing a modification of the anchor end of the anchor shown in FIGS. 3A and 4A.
Figure 4A:
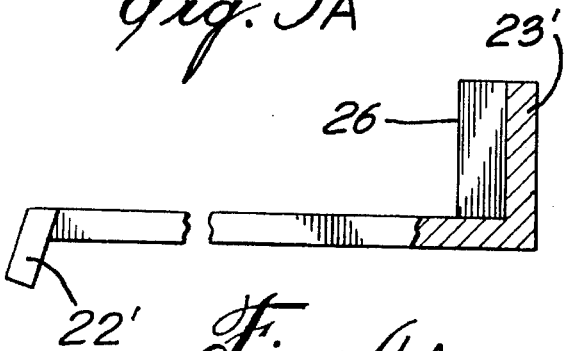
FIG. 4A is a side view of FIG. 3A.

The anchor end 23 of the anchor is also formed with a transverse flange 23' which is provided with a retention face 26 which extends transversely to the stem and extends upwardly therefrom, as clearly illustrated in FIG. 4A. Accordingly, as shown in FIG. 2, as the wall 17 is erected the anchor 20 is positioned within the transverse groove 18 and another block 10' is positioned thereover to lock the anchor 20 in place. Back-fill material, such as shown at 27, is then added behind the wall as the wall is constructed. With these anchors 20 it is also possible to add the back-fill material later on, but if it to be compacted, it is preferable to add the fill as the wall is erected whereby not to disturb the anchors. As also shown in FIG. 3A, the transverse anchor flange 23' may extend from both sides of the stem 21 and is angled forwardly towards the hook end 22 to provide added retention force against the forward movement of the block.

FIG. 3B illustrates a modification of the hook end 22, and as herein shown, the hook end may be constituted simply by an extension 28 of the elongated stem 21 which is provided with an angulated end section 29 bent, as shown at 22' in FIG. 4A, or at any other angle, such as a right angle, to abut a rear side wall of the anchoring channel 11'. As previously described, the anchoring channel 11' may be a short channel positioned spaced from the rear wall 15 of the block 10.

FIG. 4B also shows an alternative construction of the anchor end 23. As herein shown, FIG. 4B is a side view similar to FIG. 4A, but the anchor flange 23' is herein shown at 30 as extending above and below the stem section 21. This flange 30 may also be angulated forwardly, as shown in FIG. 3A. Other obvious modifications of the hook end and anchor end are conceivable and the stem section 21 could be a rod-like section instead of a flat flange-like section, as herein shown. If constructed of metal, the anchor may be galvanized or could be formed of aluminum to have anti-rusting properties.

It is within the ambit of the present invention to cover any other obvious modifications of the embodiment of the invention described herein, provided such modifications fall within the scope of the appended claims.

We claim:

1. An anchor adapted for providing retention strength to a retaining wall formed of a plurality of superimposed blocks having opposed faces adapted to lie one on top of another, at least a top one of said faces of at least some of said blocks having a longitudinal channel therein disposed spaced from a rear wall thereof and extending along a longitudinal axis of said block, a transverse groove in said top face extending from said longitudinal groove to said rear wall, said anchor having an elongated stem section, a flange hook end at an end of said stem section adapted for engagement in said longitudinal channel against a rear side wall of said channel, and an opposed anchor end for engagement with back-fill material disposed behind said retaining wall, said stem having a cross-section dimensioned to extend through said transverse groove in an unobstructing manner when said blocks are disposed one on top of another, said anchor end being constituted by a transverse rectangular flange formed at an opposed end of said stem section and having opposed arms extending on a respective side of said stem section, said arms being angulated toward said hook end of said anchor, said transverse flange having a retention face extending transversely to said stem, said transverse flange extending upwardly at said opposed end in an opposite direction to said hook end which is disposed at an angle to said stem section downwardly for abutment against said rear side wall of said longitudinal channel.

2. An anchor as claimed in claim 1 wherein said anchor is formed of a metallic material, said stem section being a flat rectangular stem.

3. An anchor as claimed in claim 1 wherein said transverse flange extends transversely and protrudes from both sides of said stem section.

4. An anchor as claimed in claim 1 wherein said anchor is molded from a structural plastics material.

5. An anchor as claimed in claim 1 wherein said anchor is formed of a metallic material having anti-rusting properties.

* * * * *